US008474578B2

(12) United States Patent
Halford et al.

(10) Patent No.: US 8,474,578 B2
(45) Date of Patent: Jul. 2, 2013

(54) BRAKE BEAM WEAR LINER

(75) Inventors: Joseph Halford, St. Louis, MO (US); Stephen Becker, St. Louis, MO (US); Jay Monaco, Glen Carbon, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 335 days.

(21) Appl. No.: 12/806,409

(22) Filed: Aug. 13, 2010

(65) Prior Publication Data

US 2012/0037032 A1 Feb. 16, 2012

(51) Int. Cl.
*B61H 13/00* (2006.01)

(52) U.S. Cl.
USPC ..... 188/52; 188/233.3

(58) Field of Classification Search
USPC ..... 188/52, 207, 212, 214, 233.3; 473/113; D12/47; 52/846; 384/42, 299
IPC ..... B61H 13/34,13/36, 13/38
See application file for complete search history.

(56) References Cited

U.S. PATENT DOCUMENTS

| | | | | | |
|---|---|---|---|---|---|
| 87,278 | A | * | 2/1869 | Montgomery | 52/846 |
| 2,525,762 | A | * | 10/1950 | Baselt | 188/212 |
| 2,723,008 | A | * | 11/1955 | Cottrell | 188/212 |
| 2,808,906 | A | * | 10/1957 | Busch | 188/190 |
| 3,020,984 | A | * | 2/1962 | Le Bean | 188/212 |
| 3,094,196 | A | * | 6/1963 | Sweger | 188/210 |
| 4,094,253 | A | * | 6/1978 | Gage | 105/225 |
| 4,471,857 | A | | 9/1984 | Murphy | |
| 5,421,437 | A | | 6/1995 | Malachowski | |
| 5,682,964 | A | | 11/1997 | Murphy | |
| 5,924,654 | A | * | 7/1999 | Anderson | 246/169 R |
| 6,367,590 | B1 | | 4/2002 | Burke | |
| D497,838 | S | | 11/2004 | Anderson | |
| 7,527,131 | B1 | | 5/2009 | Wike | |

OTHER PUBLICATIONS

Wear Plate for Unit Type Brake Beam Guide in Side Frame; Standard S-367-83; Adopted: 1964, Revised: 1982, 1997, 1 pg.
Design Dimensions for Unit Guide Bracket EC-20551, Standard, S-366, Adopted: 1964, Revised: 1990, 1997, 2006, 1 pg.

* cited by examiner

*Primary Examiner* — Robert A Siconolfi
*Assistant Examiner* — Stephen Bowes
(74) *Attorney, Agent, or Firm* — Edward J. Brosius

(57) ABSTRACT

A brake beam wear liner for receiving a brake beam assembly of a railway car truck includes a base wall having an inner surface and an outer surface extending between opposite side edges, and having a base wall thickness between the inner surface and the outer surface thereof. The brake beam wear liner also includes sidewalls extending from the opposite side edges. The sidewalls have inner surfaces and outer surfaces, and have a sidewall thickness between the inner surface and the outer surface thereof. The inner surfaces of the sidewalls and the inner surface of the base wall define an open ended trough configured to receive an end of the brake beam assembly. The brake beam wear liner also includes flanges extending outward from the sidewalls. The flanges have inner surfaces and outer surfaces, and have a flange thickness between the inner surfaces and the outer surfaces thereof. The base wall thickness is greater than the sidewall thickness.

7 Claims, 6 Drawing Sheets

BRAKE BEAM WEAR LINER

BACKGROUND OF THE INVENTION

The subject matter herein relates to a railway car truck and, more particularly, to a railway car truck having an improved brake beam wear liner.

In a railway car truck, two axles are held in a pair of laterally spaced side frames, with a bolster extending laterally between and supported on each side frame. The wheels are press fit on the axles, with the ends of the axles also fitted with a roller bearing assembly. The roller bearing assembly is fit into a bearing adapter that is fit into a pedestal jaw opening at the longitudinal end of each side frame.

Each railway car truck also includes a braking system having two brake beams that act to transmit braking force through brake shoes to the outer tread of the railway wheels. The brake beams are attached to the side frames in corresponding guide brackets (AAR standard S-366, 2006 revision). For example, ends of the brake beams are received in the guide brackets. The brake beams are movable within the guide brackets during application of the braking system. Typically, wear plates (AAR standard S-367, 1997 revision) are positioned within the guide brackets. The wear plates have a base wall, opposed sidewalls and flanges extending from the ends of the sidewalls opposite the base wall.

During operation, the side frames tend to shift with respect to one another, such as when the railway car truck is going around a bend, or when the load supported by the railway car truck shifts or changes. The side frames may tend to shift inboard, which could squeeze in on the brake beam. As such, the brake beam is typically sized to create a gap or tolerance between the wear plates to avoid binding of the brake beams. However, such gap may be too wide in some situations, such as when the brake beam is off-center or kinked out of alignment, or when the brake beam used is undersized for the particular rail gauge. When the gap is too wide, the brake beam is allowed to migrate within the pockets of the guide brackets, which could lead to damage of the railcar wheels. For example, when the brake beam shifts over to one side or the other, the brake shoe and/or the brake head holding the brake shoe may begin to rub on the flange of the railway wheel, causing damage and/or failure of the railway wheel. Furthermore, the problem with brake beam shift may be exaggerated on particular types of railway cars, such as hopper cars, where the lever actuating the brake beam is angled to one side. As the brake beam is pulled to the side, the brake shoe and/or the brake head are similarly pulled toward the flange of the railway wheel.

A need exists for an improved railway car truck having a brake beam wear liner that can compensate for conditions where the brake beam is too short or subject to being off-set.

BRIEF DESCRIPTION OF THE INVENTION

In one embodiment, a brake beam wear liner is provided for receiving a brake beam assembly. The brake beam wear liner includes a base wall having an inner surface and an outer surface extending between opposite side edges, and having a base wall thickness between the inner surface and the outer surface thereof. The brake beam wear liner also includes sidewalls extending from the opposite side edges. The sidewalls have inner surfaces and outer surfaces, and have a sidewall thickness between the inner surface and the outer surface thereof. The inner surfaces of the sidewalls and the inner surface of the base wall define an open ended trough configured to receive an end of the brake beam assembly. The brake beam wear liner also includes flanges extending outward from the sidewalls. The flanges have inner surfaces and outer surfaces, and have a flange thickness between the inner surfaces and the outer surfaces thereof. The base wall thickness is greater than the sidewall thickness.

In another embodiment, a brake system is provided for a railway car truck. The brake system includes a brake beam assembly configured to be mounted between opposed side frames of the railway car truck. The brake beam assembly has a brake beam with opposite ends and paddles at the ends. The brake beam assembly has brake heads proximate to the ends of the brake beam and each brake head holds a brake shoe configured to engage a wheel. The brake system also includes brake beam wear liners configured to be received in corresponding guide brackets on the side frames. The brake beam wear liners each include a base wall having an inner surface and an outer surface extending between opposite side edges, and having a base wall thickness between the inner surface and the outer surface thereof. The brake beam wear liner also includes sidewalls extending from the opposite side edges. The sidewalls have inner surfaces and outer surfaces, and have a sidewall thickness between the inner surface and the outer surface thereof. The inner surfaces of the sidewalls and the inner surface of the base wall define an open ended trough configured to receive an end of the brake beam assembly. The brake beam wear liner also includes flanges extending outward from the sidewalls. The flanges have inner surfaces and outer surfaces, and have a flange thickness between the inner surfaces and the outer surfaces thereof. The base wall thickness is greater than the sidewall thickness.

In a further embodiment, a railway car truck is provided including two side frames each having a pedestal formed on longitudinally opposite ends thereof. Each side frame has a pair of guide brackets on an inner side of the side frame. The railway car truck also includes a bolster transversed relative to the side frames that has laterally opposite ends supported by the side frames. Two brake beam assemblies are supported on the bolster and side frames. Each brake beam assembly includes an elongated brake beam having opposite ends and paddles at the ends. The brake beam assembly has brake heads proximate to the ends of the brake beam with each brake head holding a brake shoe configured to engage a wheel. The railway car truck also includes brake beam wear liners received in corresponding guide brackets on the side frames. The brake beam wear liners each include a base wall having an inner surface and an outer surface extending between opposite side edges, and having a base wall thickness between the inner surface and the outer surface thereof. The brake beam wear liner also includes sidewalls extending from the opposite side edges. The sidewalls have inner surfaces and outer surfaces, and have a sidewall thickness between the inner surface and the outer surface thereof. The inner surfaces of the sidewalls and the inner surface of the base wall define an open ended trough configured to receive an end of the brake beam assembly. The brake beam wear liner also includes flanges extending outward from the sidewalls. The flanges have inner surfaces and outer surfaces, and have a flange thickness between the inner surfaces and the outer surfaces thereof. The base wall thickness is greater than the sidewall thickness.

DETAILED DESCRIPTION OF THE INVENTION

Figure 1:
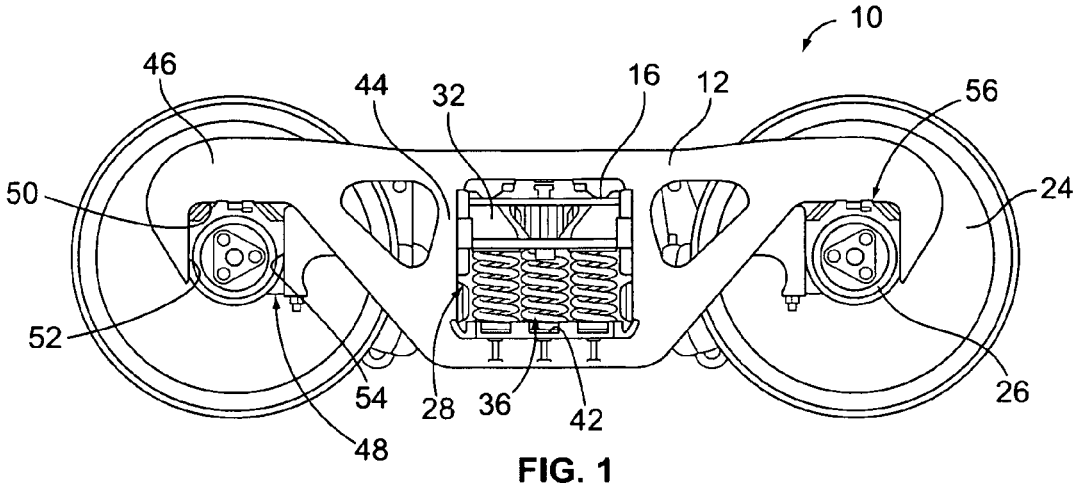
FIG. 1 is a side view of a railway car truck formed in accordance with an exemplary embodiment.
Figure 2:
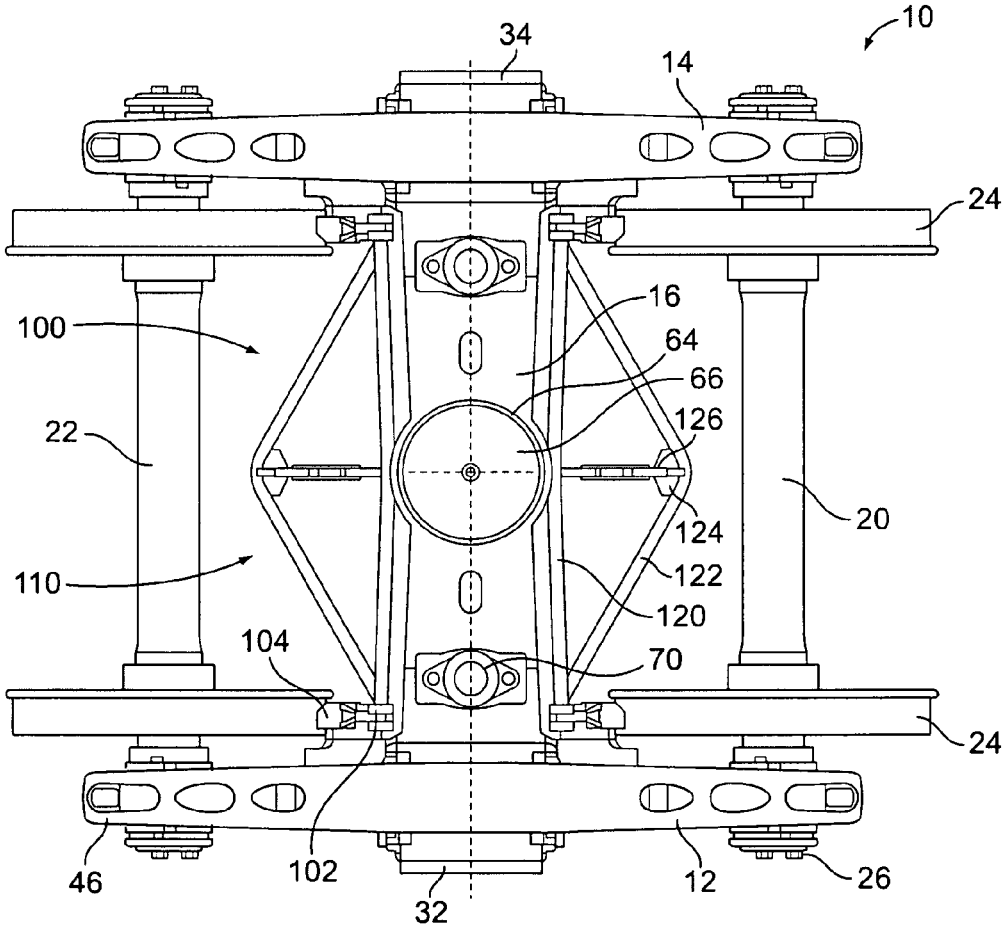
FIG. 2 is a top view of the railway car truck shown in FIG. 1.
Figure 3:
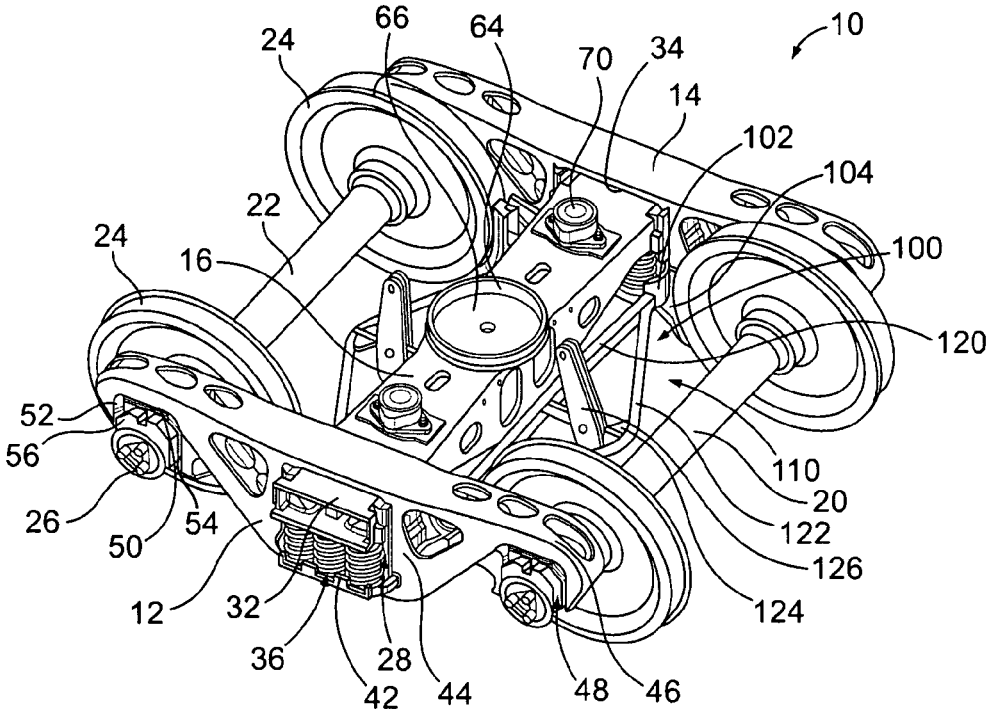
FIG. 3 is a perspective view of the railway car truck shown in FIG. 1.

Referring now to FIGS. 1-3, a railway car truck 10 is shown. The railway car truck 10 includes two laterally spaced side frames 12 and 14, between which a bolster 16 extends. Each of the side frames 12, 14 and bolster 16 are usually a cast steel unitary structure. Various internal ribs and supports lend strength, along with a savings in overall weight for each of such cast steel truck components.

Axles 20 and 22 extend laterally between the side frames 12, 14. Railway wheels 24 are press fit on the ends of the axles 20, 22. Roller bearing assemblies 26 are also provided on the ends of the axles 20, 22. The side frames 12, 14 include side frame openings 28 aligned with the bolster 16.

The bolster 16 is seen to include bolster ends 32 and 34, which extend through the side frame openings 28. Spring groups 36 support the bolster ends 32 on a side frame lower support 42. The side frames 12, 14 include vertical columns 44 that are longitudinally spaced and form the side frame openings 28 therebetween. The lower support section 42 has various raised structures adapted to position the spring group 36 thereupon.

The side frames 12, 14 are also seen to have laterally spaced pedestal jaws 46 which are the further most lateral extent of the side frames 12, 14. Each pedestal jaw 46 forms a pedestal jaw opening 48, which is comprised of a roof section 50, an outer wall 52, and an inner wall 54. The pedestal jaw opening 48 is adapted to receive a bearing adapter 56 therein. The bearing adaptors 56 rest on the roller bearing assemblies 26.

The bolster 16 includes on its upper surface a bolster center plate 64, which includes a bolster center plate wear liner 66. Also included on the upper surface of the bolster 16 is a pair of laterally spaced side bearings 70.

The railway car truck 10 includes a brake system 100 having brake heads 102 that support brake shoes 104. The brake system 100 is operated to press the brake shoes 104 against the railway wheels 24. The brake heads 102 may be fabricated or cast steel devices. The brake system 100 includes a brake beam assembly 110 supported from the side frames 12, 14 and the bolster 16.

The brake beam assembly 110 includes a brake beam 120, which is generally elongated and extends laterally between the side frames 12, 14. The brake shoes 104 are provided proximate to the ends of the brake beam 120, generally aligned with the railway wheels 24. Support sections 122 extend at acute angles from ends of the brake beam 120. A standoff section 124 extends from a center portion of the brake beam 120 to the apex of the curved or bent support sections 122. The brake beams 120, support sections 122 and standoff sections 124 are typically comprised of structural steel, and may be in the form of a hollow structural steel sections. One or more levers 126 are connected to the brake beam assembly 110, such as to the standoff sections 124, to actuate the brake beam assembly 110 during braking. The levers 126 may be oriented substantially vertically. Alternatively, the levers 126 may be angled, such as at approximately a 45° angle, such as on a hopper freight car, where clearance above the levers 126 is limited. When angled, the levers 126 tend to pull the brake beam assembly 110 toward one side of the railway car truck 10, which may cause the brake shoes 104 to rub against the railway wheels 24 causing damage to the railway wheels 24.

Figure 4:
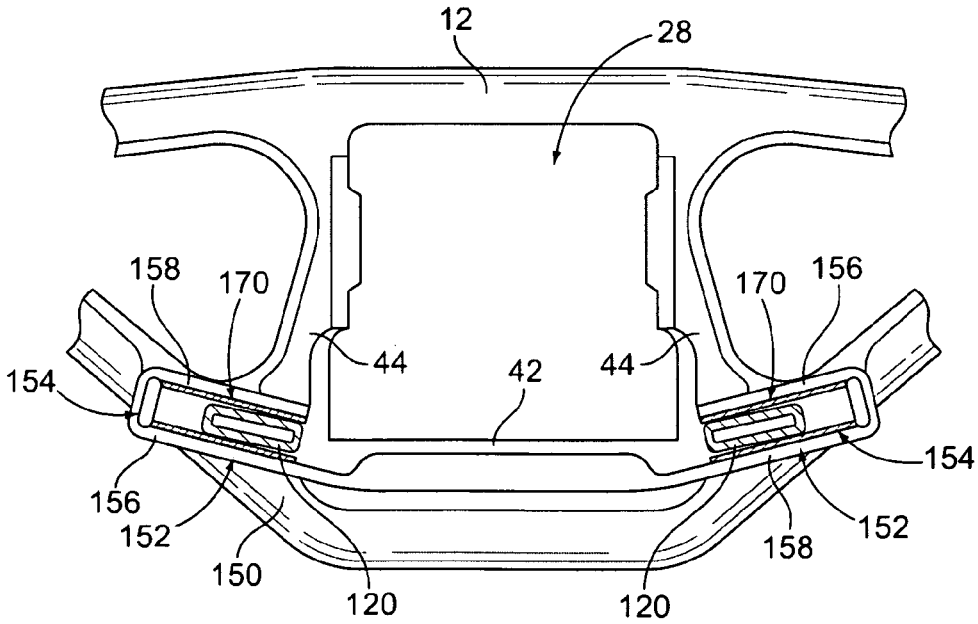
FIG. 4 is a side view of a portion of the railway car truck shown in FIG. 1.

FIG. 4 is a side view of a portion of the railway car truck 10 illustrating a portion of an inner side 150 of the side frame 14. The side frame 14 includes guide brackets 152 extending inward from the side frame 14. Optionally, the guide brackets 152 integrally formed with the side frame 14. The guide brackets 152 are positioned along the vertical column 44 proximate to the side frame opening 28. The guide brackets 152 are positioned proximate to the lower support section 42 on each side of the side frame opening 28. Similarly, the side frame 12 (shown in FIGS. 2 and 3) includes a pair of guide brackets that are substantially similar to the guide brackets 152.

The guide bracket 152 includes a pocket 154 that is surrounded by an upper wall 156 and a lower wall 158. The upper and lower walls 156, 158 are substantially parallel to one another and project from the side frame 14 to define the pocket 154. In an exemplary embodiment, the guide bracket 152 has an open side furthest from the side frame 14 that provides access to the pocket 154. The open side extends between the upper and lower walls 156, 158. The pocket 154 receives a brake beam wear liner 170 which receives an end of the brake beam 120. In an exemplary embodiment, the guide brackets 152 may conform to AAR standards S-366. The AAR standards call for the guide bracket 152 to be inclined to the horizontal at an angle of 14° for 40, 50, 70, and 90-100 ton cars, and at an angle of 16° for 125 ton cars.

Figure 5:
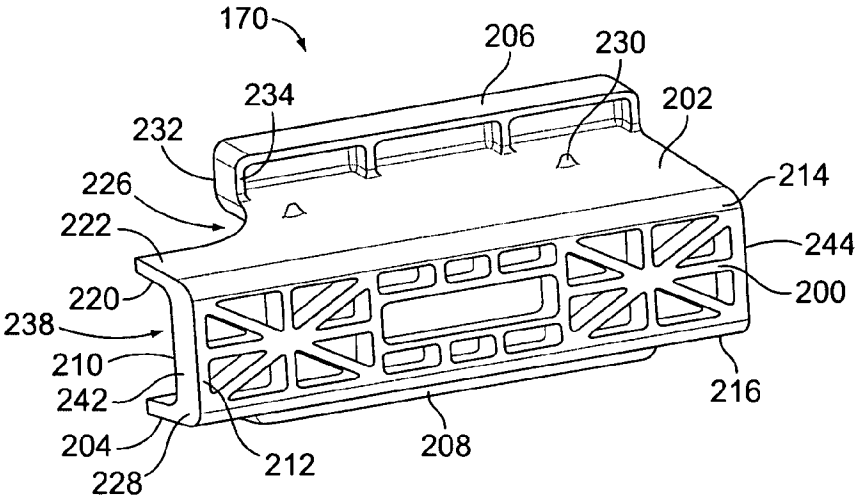
FIG. 5 is a perspective view of a brake beam wear liner for the railway car truck shown in FIG. 1.
Figure 7:
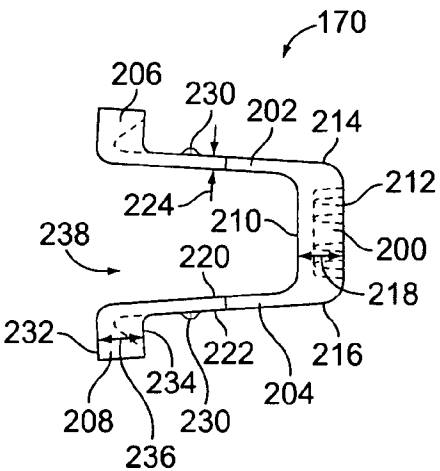
FIG. 7 is an end view of the brake beam wear liner shown in FIG. 5.
Figure 6:
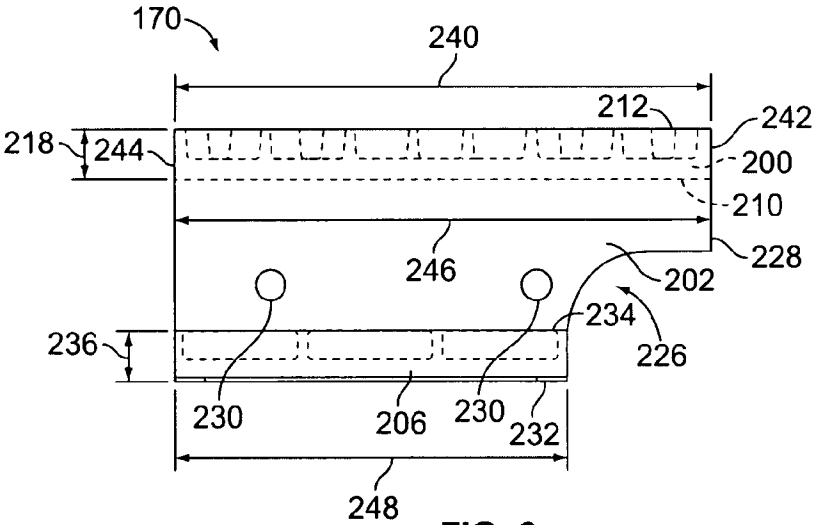
FIG. 6 is a top view of the brake beam wear liner shown in FIG. 5.

With reference to FIGS. 5-7, a brake beam wear liner 170 is shown. The brake beam wear liner 170 includes a base wall 200, side walls 202, 204 extending from the base wall 200 and flanges 206, 208 extending from the side walls 202, 204, respectively. The brake beam wear liner 170 is configured to be received in corresponding pockets 154 (shown in FIG. 4) of the guide brackets 152 (shown in FIG. 4). The brake beam wear liner 170 defines an open ended trough 238 between the side walls 202, 204. The base wall 200 is provided at a bottom of the trough 238 opposite the open end of the trough 238.

In an exemplary embodiment, the brake beam wear liner 170 is manufactured from a metal material, such as a cast steel material. Other types of metal materials may be used in alternative embodiments. A metal material used for the brake beam wear liner 170 may be manufactured by a process other than casting, such as stamping and forming the brake beam wear liner 170. Alternatively, the brake beam wear liner 170 may be fabricated from a synthetic material, such as a nylon material. Optionally, an impact resistant nylon material may be used. Other types of synthetic materials may be used in alternative embodiments.

The base wall 200 has an inner surface 210 and an outer surface 212 extending between opposite side edges 214, 216. The base wall 200 has a base wall thickness 218 measured between the inner and outer surfaces 210, 212.

Each side wall 202, 204 has an inner surface 220 and an outer surface 222 that transition into the inner and outer surfaces 210, 212, respectively, of the base wall 200. The side walls 202, 204 extend from the opposite side edges 214, 216, respectively, of the base wall 200. The side walls 202, 204 each have a side wall thickness 224 measured between the inner and outer surfaces 220, 222. The side walls 202, 204 have cutouts 226 at a front 228 of the brake beam wear liner 170. Optionally, each cutout 226 may have a radiused surface. The side walls 202, 204 include a pair of outwardly extending rounded protuberances 230 that are configured to engage the guide bracket 152 to hold the brake beam wear liner 170 within the pocket 154.

The flanges 206, 208 extend outward from the side walls 202, 204, respectively, generally opposite the base wall 200. The flanges 206, 208 have inner surfaces 232 and outer surfaces 234 that transition into the inner and outer surfaces 220, 222, respectively, of the corresponding side wall 202, 204. The flanges 206, 208 have a flange thickness 236 measured between the inner and outer surfaces 232, 234.

The base wall 200 has a longitudinal length 240 measured between a first end 242 and a second end 244. Similarly, the side walls 202, 204 have a longitudinal length 246. Optionally, the side wall lengths 246 may be substantially equal to the base wall length 240. The flanges 206, 208 have a longitudinal length 248. Optionally, the flange length 248 may be shorter than the side wall length 246.

In an exemplary embodiment, portions of the brake beam wear liner 170 conform to AAR standard S-367, while other portions of the brake beam wear liner 170 do not conform to the AAR standard S-367. For example, the base wall thickness 218 may be thicker than the base wall thickness designated by the standard. The brake beam wear liner 170 can thus compensate for conditions where the brake beam 120 is too short or subject to being off-set. Optionally, the flange thickness 236 may be thicker than the flange thickness designated by the standard. Optionally, the base wall thickness 218 may be at least twice the side wall thickness 224. For example, the side wall thickness 224 may be $3/16^{th}$" (0.1875") thick. Optionally, the base wall thickness 218 may be approximately $11/16^{th}$" (0.6875") thick. As such, the base wall thickness 218 is a half inch thicker the side wall thickness 224. Optionally, the flange thickness 236 may be $11/16^{th}$" (0.6875") thick. The flange thickness 236 may be the same as the base wall thickness 218. Alternatively, the flange thickness 236 may be different than the base wall thickness 218.

In an exemplary embodiment, the thickness is added to the inner surface 210 of the base wall 200 and the inner surface 232 of the flanges 206, 208. As such, the protuberances 230 are positioned predetermined distances from the outer surfaces 212 of the base wall 200 and the outer surfaces 234 of the flanges 206, 208, which correspond to the standard.

Figure 8:
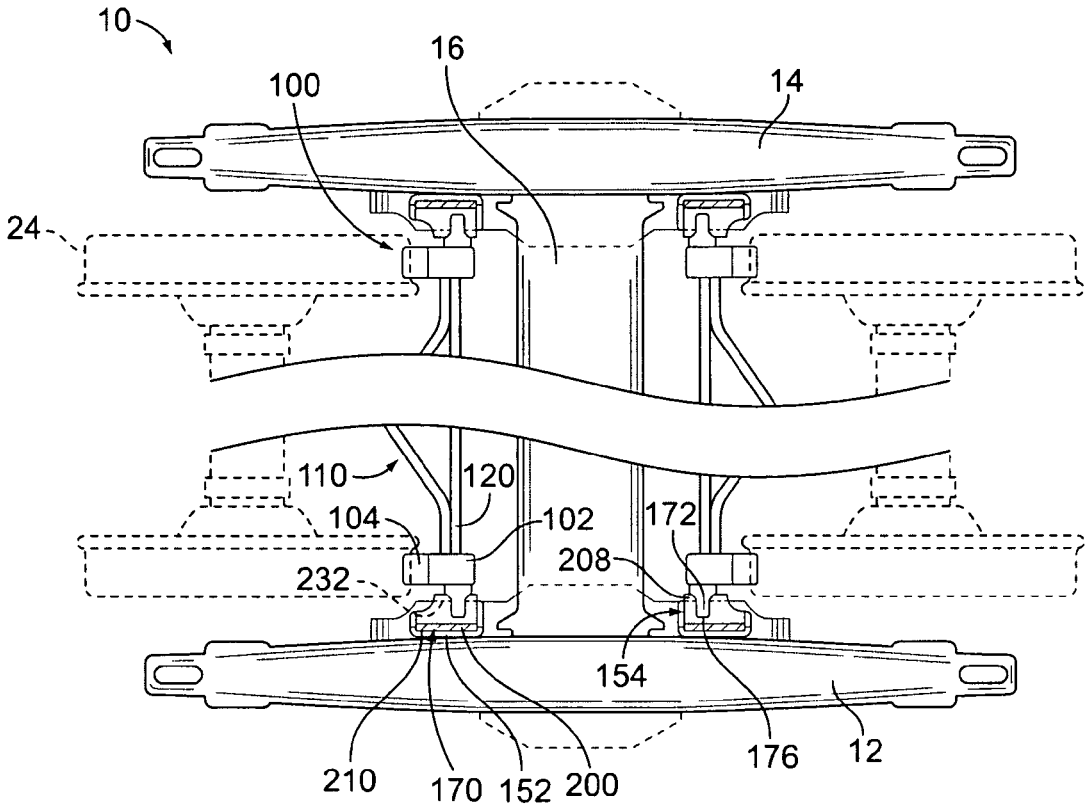
FIG. 8 is a top, partial section view of a portion of the railway truck shown in FIG. 1.

FIG. 8 is a top, partial sectional view of a portion of the railway car truck 10 illustrating brake beam wear liners 170 received in corresponding guide brackets 152 of the side frame 14. FIG. 8 also illustrates a portion of the bolster 16, the railway wheels 24 and a portion of the brake system 100. The brake heads 102 are shown coupled to the brake beam assembly 110 at ends of the brake beams 120 aligned with the railway wheels 24.

The brake beam wear liners 170 are shown loaded into the guide brackets 152. The brake beam wear liners 170 may be substantially similar to wear liners conforming to AAR standard S-367, 1997 revision. Ends of the brake beams 120 are configured to extend into the brake beam wear liner 170. For example, ends of the brake beams 120 include paddles 172 that are configured to extend into the brake beam wear liners 170. During operation of the brake system 100, the brake beam assemblies 110 may be pressed toward the corresponding railway wheels 24 to apply braking pressure to the railway wheels 24. The levers 126 (shown in FIG. 4) actuate the brake assemblies 110 during braking. Movement of the brake beam assemblies 110 is guided by the brake beam wear liners 170. For example, the brake beam wear liners 170 limit movement of the brake beams 120 along a generally linear path toward, and away from, the railway wheels 24. The brake beams 120 have a linear range of motion defined by the brake beam wear liners 170.

The added thickness in the base wall 200 and/or the flanges 206, 208 affects the positioning of the brake beam wear liner 170 within the guide bracket 152. For example, the brake beam wear liner 170 is configured to be positioned further outward than a brake beam wear liner that conforms to the standard. As such, the inner surface 210 of the base wall 200 is positioned further into the pocket 154 of the guide bracket 152 than a brake beam wear liner conforming to the standard. Similarly, the inner surfaces 232 of the flanges 206, 208 are positioned further from the outer edge of the corresponding guide brackets 152. The added thickness of the flanges 206, 208 serves as a visual indicator that a non-standard brake beam wear liner is in use, as the flanges 206, 208 are the portion of the brake beam wear liner 170 that is provided external of the guide brackets 152.

The extra thickness in the brake beam wear liner 170 positions the brake beam wear liner 170 closer to the brake beam 120. The extra thickness in the brake beam wear liner 170 can accommodate brake beams 120 that have a shorter length than required based on the rail gauge of the railway car truck 10. Such additional thickness in the brake beam wear liner 170 compensates for pocket conditions that are too wide for a particular brake beam assembly 110. Additionally, such added thickness in the brake beam wear liner 170 compensates for situations where the brake beam assembly 110 is off-center or tends to shift off-center between the side frames 12, 14, which may be caused by the levers 126 pulling the brake beams 120 toward one of the side frames 12 or 14, such as may be the case in hopper cars. When the brake beam assembly 110 is pulled to one side, the effective length of the brake beam assembly 110 between the corresponding guide brackets 152 may be shortened and/or the position of the brake shoe 104 may be shifted, which may cause damage to the railway wheels 24.

The brake beam assemblies 110 are not physically connected to the side frames 14. Rather, the brake beam assemblies 110 are free-floating between the side frames 12, 14. The brake beams 120 have an axial length measured between distal ends 176 of the paddles 172. The axial length of each brake beam 120 is selected to fit between the brake beam wear liners 170. The brake beam wear liners 170 associated with a particular brake beam 120 are spaced apart from one another by an axial distance that is longer than the axial length of the brake beams 120. As such, binding of the brake beam 120 is reduced or eliminated.

The added thickness of the brake beam wear liners 170 at the base wall 200 and/or the flanges 206, 208 compensate for conditions where the brake beam 120 is too short or subject to being off-set. For example, having each brake beam wear liners 170 manufactured with an additional 0.5" thickness at the base wall 200 and/or the flanges 206, 208, which allows the brake beam wear liners 170 to take up a 1" gap as compared to brake beam wear liners that conform to the standard. Additionally, the axial distance between the side frames 12, 14 may change as the railway car truck 10 passes down the railway track. For example, the axial distance may increase such as when the railway car truck 10 curves around a bend or as the load supported by the railway car truck 10 shifts. Having thicker brake beam wear liners may help center the brake beam 120 in such situations.

Figure 11:
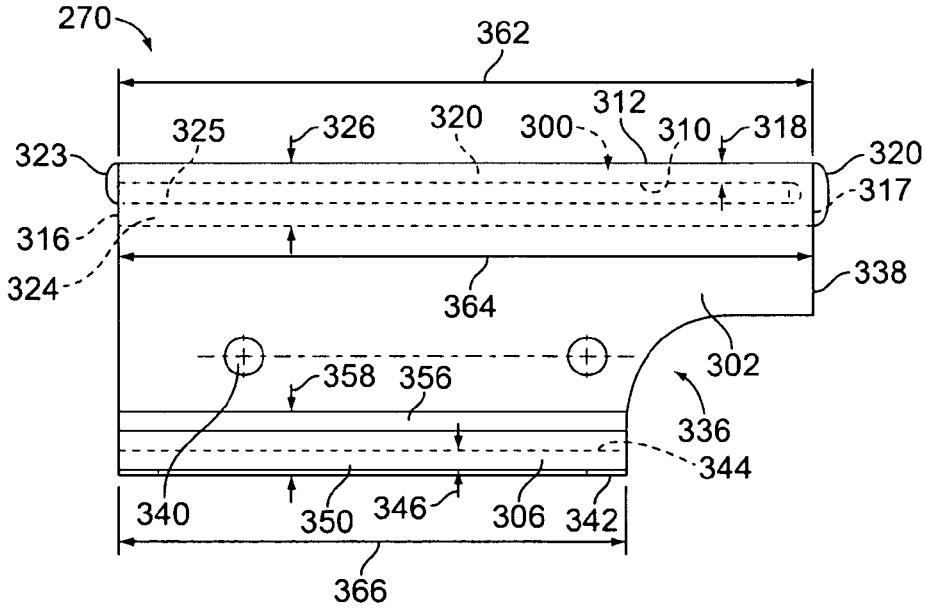
FIG. 11 is a cross sectional view of the brake beam wear liner shown in FIG. 9 in a second stage of manufacture.
Figure 9:
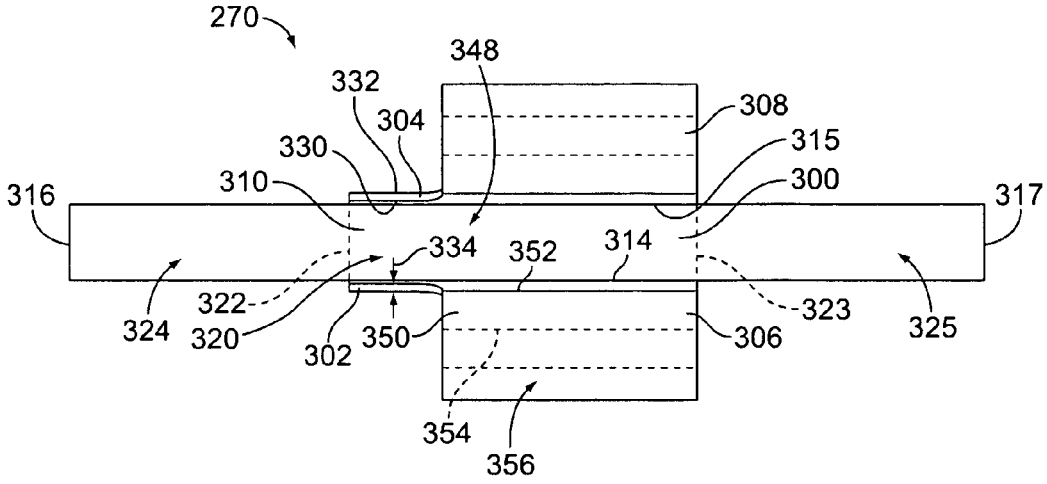
FIG. 9 is a side view of an alternative brake beam wear liner in a first stage of manufacture.
Figure 10:
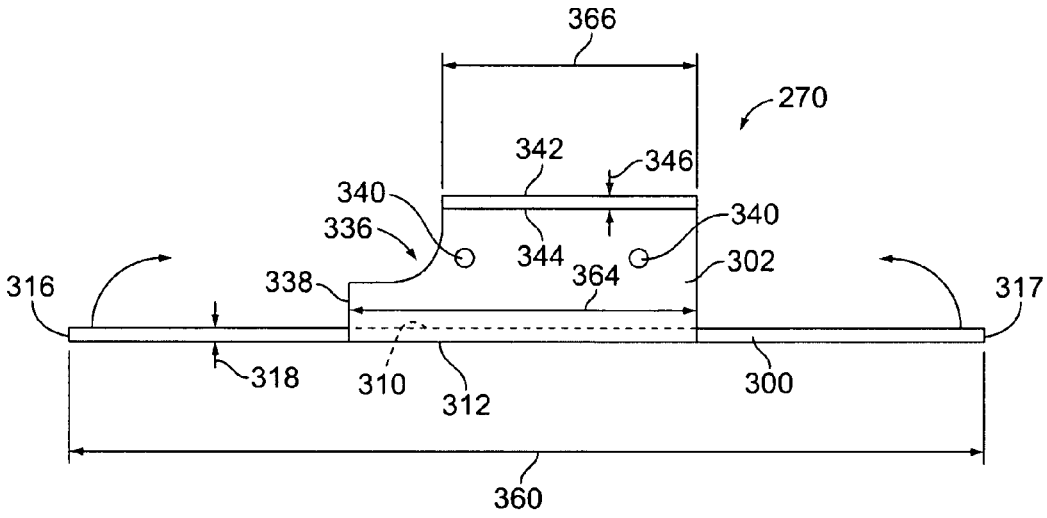
FIG. 10 is a top view of the brake beam wear liner shown in FIG. 9.

With reference to FIGS. 9-11, a brake beam wear liner 270 is shown. The brake beam wear liner 270 is similar to the brake beam wear liner 170 in some respects, and may be used in place of the brake beam wear liner 170. The brake beam wear liner 270 is configured to be received in corresponding pockets 154 (shown in FIG. 5) of the guide brackets 152 (shown in FIG. 5).

The brake beam wear liner 270 includes a base wall 300, side walls 302, 304 extending from the base wall 300 and flanges 306, 308 extending from the side walls 302, 304, respectively. The brake beam wear liner 270 defines an open ended trough 348 between the side walls 302, 304. The base wall 300 is provided at a bottom of the trough 348 opposite the open end of the trough 348.

In an exemplary embodiment, the brake beam wear liner 270 is manufactured from a metal material, and is configured to be stamped and formed. For example, the brake beam wear liner 270 may be stamped from a metal piece of material and formed into the shape shown in FIGS. 9 and 10. The brake beam wear liner 270 is then further formed into the final shape shown in FIG. 11. As described in further detail below, the final forming step is performed to add thickness to the base wall 300 and the flanges 306, 308.

The base wall 300 has an inner surface 310 and an outer surface 312 extending between opposite side edges 314, 315. The base wall 300 extends between a first end 316 and a second end 317. The base wall 300 has a material base wall thickness 318 measured between the inner and outer surfaces 310, 312.

The base wall 300 includes a central portion 320 extending between a front end 322 and a rear end 323 (both shown in FIG. 11). The base wall 300 also includes a first extension 324 extending from the front end 322 to the first end 316 and a second extension 325 extending from the rear end 323 to the second end 317. During manufacture, the first and second extensions 324, 325 are folded over or under the central portion 320, which increases a thickness of the base wall 300 to a folded thickness 326 (shown in FIG. 11) that is thicker than the material base wall thickness 318. Optionally, because the first and second extensions 324, 325 have the same material base wall thickness 318 as the central portion 320, the folded thickness 326 is approximately three times the material base wall thickness 318.

In an alternative embodiment, the base wall 300 may only include either the first extension 324 or the second extension 325, but not both. Optionally, the first extension 324 or the second extension 325 may be folded over multiple times to increase the thickness of the base wall 300 to a greater thickness.

Each side wall 302, 304 has an inner surface 330 and an outer surface 332 that transition into the inner and outer surfaces 310, 312, respectively, of the base wall 300. The side walls 302, 304 extend from the opposite side edges 314, 315, respectively, of the base wall 300. The side walls 302, 304 each have a side wall thickness 334 measured between the inner and outer surfaces 330, 332. The side walls 302, 304 have cutouts 336 at a front 338 of the brake beam wear liner 270. Optionally, the cutout 336 may have a radiused surface. The side walls 302, 304 include a pair of outwardly extending rounded protuberances 340 that are configured to engage the guide bracket 152 to hold the brake beam wear liner 270 within the pocket 154.

The flanges 306, 308 extend outward from the side walls 302, 304, respectively, generally opposite the base wall 300. The flanges 306, 308 have inner surfaces 342 and outer surfaces 344 that transition into the inner and outer surfaces 330, 332, respectively, of the corresponding side wall 302, 304. The flanges 306, 308 have a material flange thickness 346 measured between the inner and outer surfaces 342, 344.

Each flange 306, 308 includes a main portion 350 extending between a first end 352 at the corresponding side wall 302, 304 and a second end 354 (shown in FIG. 11). The flanges 306, 308 also include extensions 356 extending from the second end 354. During manufacture, the extensions 356 are folded over or under the main portion 350, which increases a thickness of the flanges 306, 308 to a folded thickness 358 (shown in FIG. 11) that is thicker than the material flange thickness 346. Optionally, the extensions 356 may be folded over more than once, leading to increased thickness of the flanges 306, 308. For example, when folded over twice, the folded thickness 358 is approximately three times the material flange thickness 346.

The base wall 300 has an initial longitudinal length 360 measured between the first end 316 and the second end 317, which includes the longitudinal lengths of the central portion 320, as well as the first and second extensions 324, 325. After the first and second extensions 324, 325 are folded onto the central portion 320, the base wall 300 has a final longitudinal length 362 measured between the front end 322 and the rear end 323. The final longitudinal length 362 is shorter than the initial longitudinal length 360 because the extensions are folded over or under the central portion 320. Optionally, the initial longitudinal length 360 may be approximately three times the final longitudinal length 362. Similarly, the side walls 302, 304 have a longitudinal length 364. Optionally, the side wall lengths 364 may be substantially equal to the final longitudinal length 362 of the base wall 300. The flanges 306, 308 have a longitudinal length 366. Optionally, the flange length 366 may be shorter than the side wall length 364.

When manufactured, the brake beam wear liner 270 may have substantially similar size, shape and dimensions as the brake beam wear liner 170, such that the brake beam wear liners 170, 270 may be interchangeable. The thicknesses of the base wall 300 and/or flanges 306, 308 may be changed by providing more or less extensions or by changing the lengths or sizes of the extensions to allow the extensions to be folded over more than one time.

Figure 12:
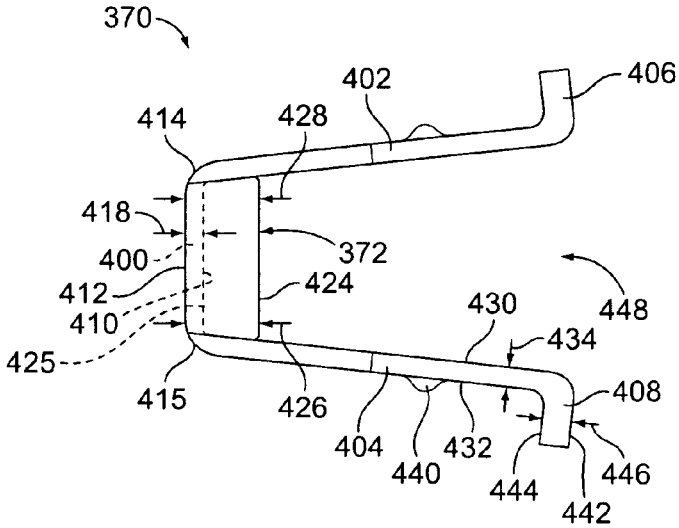
FIG. 12 is a side view of another alternative brake beam wear liner.
Figure 13:
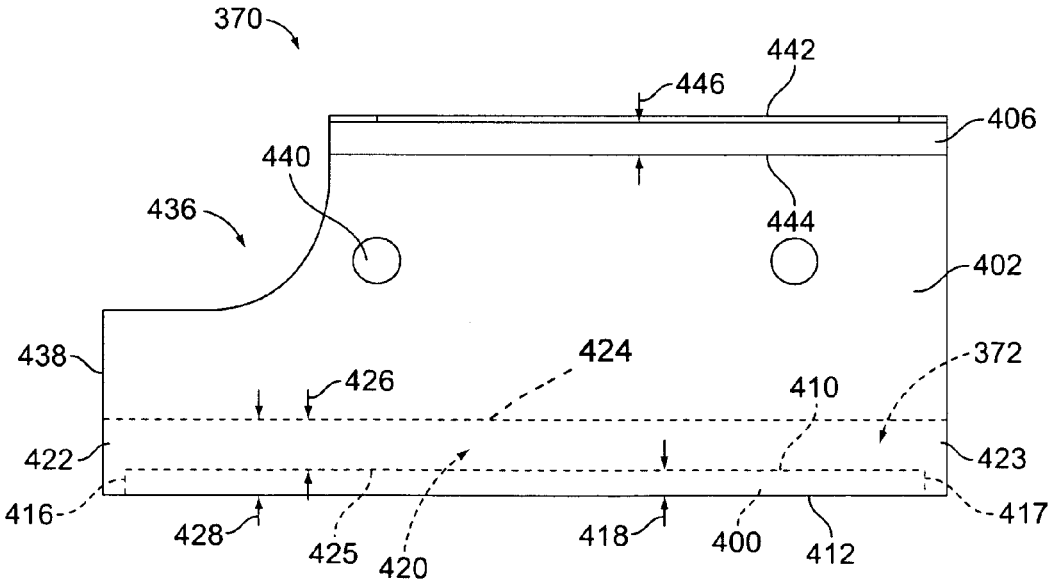
FIG. 13 is a top view of the brake beam wear liner shown in FIG. 12.

With reference to FIGS. 12-13, a brake beam wear liner 370 is shown that includes an adapter portion 372 mounted thereto to add thickness to the brake beam wear liner 370 in selected locations of the brake beam wear liner 370. The brake beam wear liner 370 is similar to the brake beam wear liners 170, 270 in some respects, and may be used in place of the brake beam wear liners 170, 270. The brake beam wear liner 370 is configured to be received in corresponding pockets 154 (shown in FIG. 5) of the guide brackets 152 (shown in FIG. 5).

The brake beam wear liner 370 includes a base wall 400, side walls 402, 404 extending from the base wall 400 and flanges 406, 408 extending from the side walls 402, 404, respectively. The brake beam wear liner 370 defines an open ended trough 448 between the side walls 402, 404. The base wall 400 is provided at a bottom of the trough 448 opposite the open end of the trough 448.

In an exemplary embodiment, the brake beam wear liner 370 is manufactured to substantially conform to AAR standard S-367; however the adaptor portion 372 adds thickness to the base wall portion 400, which makes the brake beam wear liner 370 non-conforming. Separate adaptor portions may be utilized and coupled to the brake beam wear liner 370 in addition to, or in the alternative to, the adaptor portion 372, such as at the flanges 406, 408.

The base wall 400 has an inner surface 410 and an outer surface 412 extending between opposite side edges 414, 415. The base wall 400 extends between a first end 416 and a second end 417. The base wall 400 has a material base wall thickness 418 measured between the inner and outer surfaces 410, 412.

The adaptor portion 372 includes a central portion 420 extending between a front end 422 and a rear end 423 (both shown in FIG. 11). The adaptor portion 372 includes an inner surface 424 and an outer surface 425 between the front end 422 and the rear end 423. The adaptor portion 372 has an adapter thickness 426 measured between the inner and outer surfaces 424, 425. The adaptor portion 372 may be manufactured from a metal material, such as a cast metal piece. Alternatively, the adaptor portion 372 may be manufactured from another material, such as nylon or synthetic material.

During assembly, the adaptor portion 372 is coupled to the base wall portion 400. The adaptor portion 372 may be coupled to the base wall portion 400 using fasteners, latches, tabs, interlocking features, an interference fit, or other suitable connecting means or processes. Optionally, the adaptor portion 372 may be coupled to the inner surface 410 such that the outer surface 425 of the adaptor portion 372 engages and rests on the inner surface 410 of the base wall 400. The inner surface 424 thus defines the bottom of the trough 448. Alternatively, the adaptor portion 372 may be coupled to the outer surface 412. When the adaptor portion 372 is coupled to the base wall 400, the overall thickness of the structure is increased to have a base thickness 428, which is defined by the base wall thickness 418 and the adaptor thickness 426.

Each side wall 402, 404 has an inner surface 430 and an outer surface 432 that transition into the inner and outer surfaces 410, 412, respectively, of the base wall 400. The side walls 402, 404 extend from the opposite side edges 414, 415, respectively, of the base wall 400. The side walls 402, 404 each have a side wall thickness 434 measured between the inner and outer surfaces 430, 432. The side walls 402, 404 have cutouts 436 at a front 438 of the brake beam wear liner 370. Optionally, the cutout 436 may have a radiused surface. The side walls 402, 404 include a pair of outwardly extending rounded protuberances 440 that are configured to engage the guide bracket 152 to hold the brake beam wear liner 370 within the pocket 154.

The flanges 406, 408 extend outward from the side walls 402, 404, respectively, generally opposite the base wall 400. The flanges 406, 408 have inner surfaces 442 and outer surfaces 444 that transition into the inner and outer surfaces 430, 432, respectively, of the corresponding side wall 402, 404. The flanges 406, 408 have a flange thickness 446 measured between the inner and outer surfaces 442, 444. Optionally, flange adaptor portions may be coupled to the flanges to increase the flange thickness 446. The flange adaptor portions may be similar to the adaptor portion 372. For example, the flange adaptor portions may be manufactured from the same type of material, may attach in a similar manner, and the like.

When manufactured, the brake beam wear liner 370 may have substantially similar size, shape and dimensions as the brake beam wear liner 170, such that the brake beam wear liners 170, 370 may be interchangeable. The thicknesses of the adaptor portion 372 may be changed to control the base thickness 428 for different applications.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A brake beam wear liner for receiving a brake beam assembly, the brake beam wear liner comprising:

a base wall having an inner surface and an outer surface extending between opposite side edges, the base wall having a base wall thickness between the inner surface and the outer surface thereof;

sidewalls extending from the opposite side edges, the sidewalls having inner surfaces and outer surfaces, the sidewalk having a sidewall thickness between the inner surface and the outer surfaces thereof, the inner surfaces of the sidewalls and the inner surface of the base wall defining an open ended trough configured to receive an end of the brake beam assembly; and flanges extending outward from the sidewalls, the flanges having inner surfaces and outer surfaces, the flanges having a flange thickness between the inner surface and the outer surfaces thereof;

wherein the base wall thickness is at least twice the sidewall thickness, wherein the flange thickness is greater than the sidewall thickness, the flange thickness being approximately equal to the base wall thickness.

2. The brake beam wear liner of claim 1, wherein the base wall, the side walls and the flanges are fabricated from a nylon material.

3. A brake system for a railway car truck, the brake system comprising:

a brake beam assembly configured to be mounted between opposed side frames of the railway car truck, the brake beam assembly having a brake beam with opposite ends and paddles at the ends, the brake beam assembly having brake heads proximate to the ends of the brake beam, each brake head holding a brake shoe configured to engage a wheel; and brake beam wear liners configured to be received in corresponding guide brackets on the side frames, the brake beam wear liners each comprising:

a base wall having an inner surface and an outer surface extending between opposite side edges, the base wall having a base wall thickness between the inner surface and the outer surface thereof;

sidewalls extending from the opposite side edges, the sidewalls having inner surfaces and outer surfaces, the sidewalls having a sidewall thickness between the inner surface and the outer surfaces thereof, the inner surfaces of the sidewalls and the inner surface of the base wall defining an open ended trough receiving corresponding paddles of the brake beam assembly; and flanges extending outward from the sidewalls, the flanges having inner surfaces and outer surfaces, the flanges having a flange thickness between the inner surface and the outer surfaces thereof;

wherein the base wall thickness is greater than the sidewall thickness, wherein the flange thickness is greater than the sidewall thickness, the flange thickness being approximately equal to the base wall thickness.

4. The brake system of claim 3, wherein the base wall thickness is at least twice the sidewall thickness.

5. The brake system of claim 3, wherein the base wall, the side walls and the flanges are fabricated from a nylon material.

6. A railway car truck comprising:

two side frames, each side frame having a pedestal formed on longitudinally opposite ends thereof, each side frame having a pair of guide brackets on an inner side of the side frame;

a bolster transverse relative to the side frames and having laterally opposite ends supported by the side frames;

two brake beam assemblies supported on the bolster and side frames, each brake beam assembly comprising an elongated brake beam having opposite ends and paddles at the ends, the brake beam assembly having brake heads proximate to the ends of the brake beam, each brake head holding a brake shoe configured to engage a wheel; and brake beam wear liners received in corresponding guide brackets on the side frames, the brake beam wear liners each comprising:

a base wall having an inner surface and an outer surface extending between opposite side edges, the base wall having a base wall thickness between the inner surface and the outer surface thereof;

sidewalk extending from the opposite side edges, the sidewalls having inner surfaces and outer surfaces, the sidewalls having a sidewall thickness between the inner surface and the outer surfaces thereof, the inner surfaces of the sidewalk and the inner surface of the base wall defining an open ended trough receiving corresponding paddles of the brake beam assembly; and flanges extending outward from the sidewalls, the flanges having inner surfaces and outer surfaces, the flanges having a flange thickness between the inner surface and the outer surfaces thereof;

wherein the base wall thickness is greater than the sidewall thickness, wherein the flange thickness is greater than the sidewall thickness, the flange thickness being approximately equal to the base wall thickness.

7. The railway car truck of claim 6, wherein the base wall thickness is at least twice the sidewall thickness.

* * * * *